US010221008B2

(12) United States Patent
Bishop

(10) Patent No.: US 10,221,008 B2
(45) Date of Patent: Mar. 5, 2019

(54) EGG CARRIERS AND METHODS

(71) Applicant: Mischa Bishop, Tuscumbia, AL (US)

(72) Inventor: Mischa Bishop, Tuscumbia, AL (US)

( * ) Notice: Subject to any disclaimer, the term of this patent is extended or adjusted under 35 U.S.C. 154(b) by 102 days.

(21) Appl. No.: 15/071,652

(22) Filed: Mar. 16, 2016

(65) Prior Publication Data

US 2017/0267444 A1 Sep. 21, 2017

(51) Int. Cl.

| | |
|---|---|
| ***B65D 71/00*** | (2006.01) |
| ***B65D 85/32*** | (2006.01) |
| ***B65D 25/28*** | (2006.01) |

(52) U.S. Cl.
CPC ..... *B65D 85/32* (2013.01); *B65D 25/2867* (2013.01)

(58) Field of Classification Search
CPC .. B65D 85/32; B65D 25/2867; B65D 25/106; B65D 1/38; B65D 85/30; B65D 85/324; B65D 25/108; B65D 25/22; B65D 3/24; A47J 29/06
USPC ... 220/500, 505, 507, 508, 676, 23.83, 4.26, 220/8, 503, 506; 215/382, 379, 385; 206/521.1, 521.6, 521.8, 589, 590, 521.7; 99/440; 211/14; 294/162; 426/119
See application file for complete search history.

(56) References Cited

U.S. PATENT DOCUMENTS

| | | | | | |
|---|---|---|---|---|---|
| 186,901 | A * | 1/1877 | Townsend | A47J 29/06 294/26.5 |
| 1,437,930 | A * | 12/1922 | Cantelon | B65D 85/32 206/521.1 |
| 3,291,365 | A * | 12/1966 | Koene | B65D 71/16 206/521.7 |
| D405,293 | S * | 2/1999 | Tate | D6/552 |

* cited by examiner

*Primary Examiner* — Fenn C Mathew
*Assistant Examiner* — Elizabeth J Volz
(74) *Attorney, Agent, or Firm* — Dennen IP Law, LLC

(57) ABSTRACT

An egg carrier of the present disclosure has a housing that has an external surface and disposed in the surface of the housing are a plurality of openings. Additionally, the egg carrier has a plurality of receptacles, and each receptacle is accessible by one of the plurality of openings. Further, each receptacle has an oval-shaped internal wall forming an oval-shaped cavity for receiving an egg.

12 Claims, 5 Drawing Sheets

EGG CARRIERS AND METHODS

BACKGROUND

Recently, it has become a fad in the United States for individuals to raise chickens in their backyards. This has given rise to suburban backyard chicken coops. The coops are typically a size suitable for use in a backyard. Thus, due to the size of the chicken coops, an individual may not enter the coop. The chicken coops typically have nesting structures on which the chickens being housed may roost and lay eggs. These nesting structures often have external access.

Industrial chicken coops often have a mechanized method for collecting and gathering the eggs laid by chickens. However, in backyard the size of the chicken coops typically prohibits a system that allows for mechanized collection and gathering. Additionally, a system that allows for mechanized collection and gathering of eggs may be cost-prohibitive for individuals who have a chicken coop in their backyard. Thus, individuals typically gain external access to the nesting structures and manually collect laid eggs.

BRIEF DESCRIPTION OF THE DRAWINGS

The disclosure can be better understood with reference to the following drawings. The elements of the drawings are not necessarily to scale relative to each other, emphasis instead being placed upon clearly illustrating the principles of the disclosure. Furthermore, like reference numerals designate corresponding parts throughout the several views.

DETAILED DESCRIPTION

The present disclosure relates to egg carriers and methods. An egg carrier in accordance with an embodiment of the present disclosure has a housing having an external surface. The housing comprises a handle formed of an upper portion of the housing. Further, a plurality of opening are disposed in the external surface for receiving and retaining eggs.

In one embodiment, the housing is cylindrical. In such an embodiment, the cylindrical housing has a lateral curved surface forming the side of the cylindrical housing. Disposed within the lateral curved surface is one or more openings, and each opening is sized to receive and retain an egg. Within each opening is a tapering receptacle that forms a cavity that is substantially oval-shaped for retaining the received egg. In a wall of each receptacle is an opening formed for receiving and eliminating moisture or debris through a channel formed within the cylindrical housing that traverses the cylindrical housing parallel to the cylindrical housing's lateral curved surface.

Figure 1:
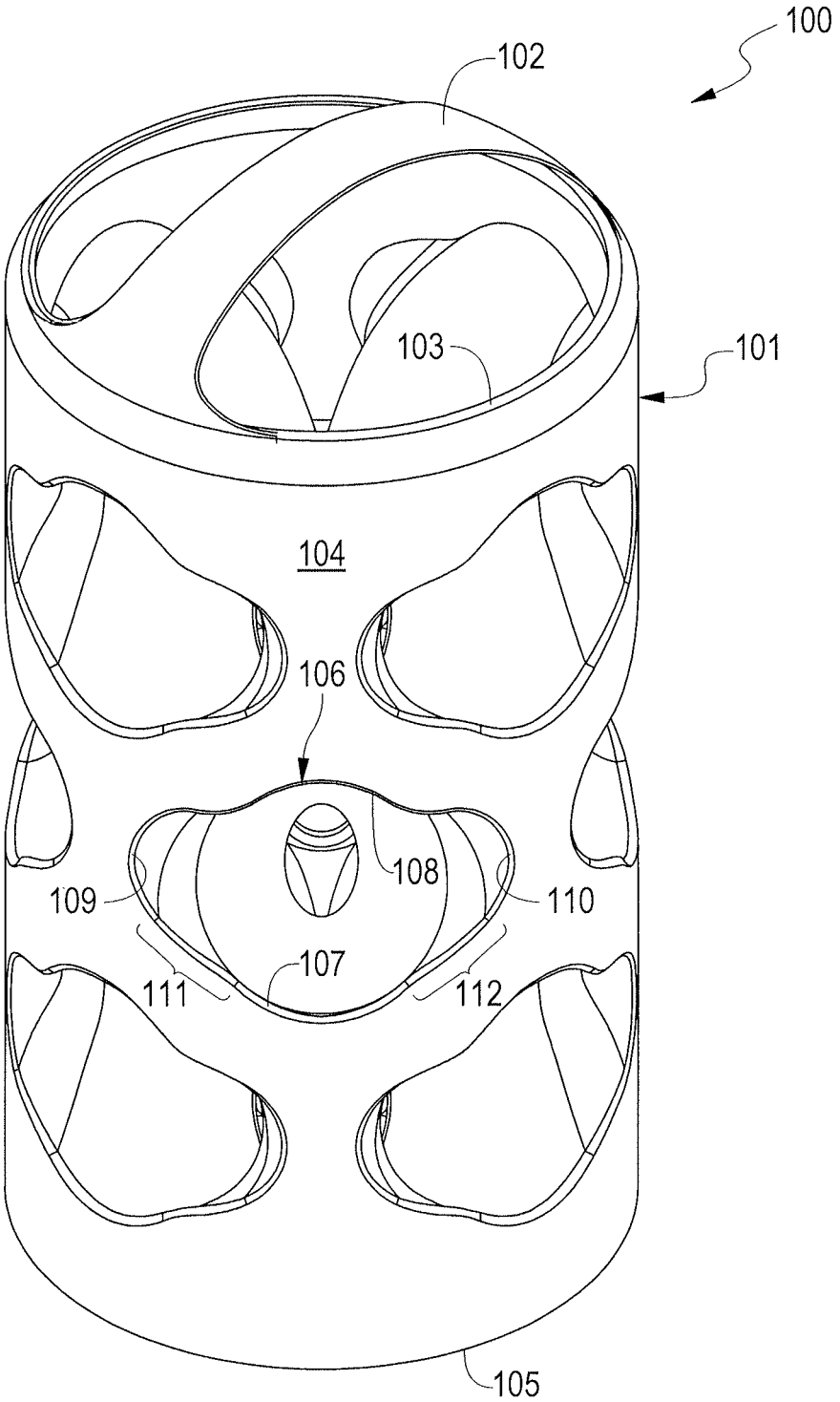
FIG. 1 is a perspective view of an exemplary egg carrier in accordance with an embodiment of the present disclosure.

FIG. 1 is a perspective view of an egg carrier 100 in accordance with an embodiment of the present disclosure. In one embodiment, the egg carrier 100 comprises a cylindrical housing 101. Note that the housing is depicted as cylindrical; however, the housing may be other shapes in other embodiments of the present disclosure.

In the embodiment depicted, the cylindrical housing 101 comprises a lateral curved surface 104. The lateral curved surface 104 terminates at a top circular edge 103 of the cylindrical housing 101. Further, the lateral curved surface 104 opposingly terminates at a bottom circular edge 105.

The cylindrical housing 101 further comprises one or more openings 106. Each opening 106 is shaped to receive an oval-shaped egg. In one embodiment, each opening is substantially circular.

Figure 2:
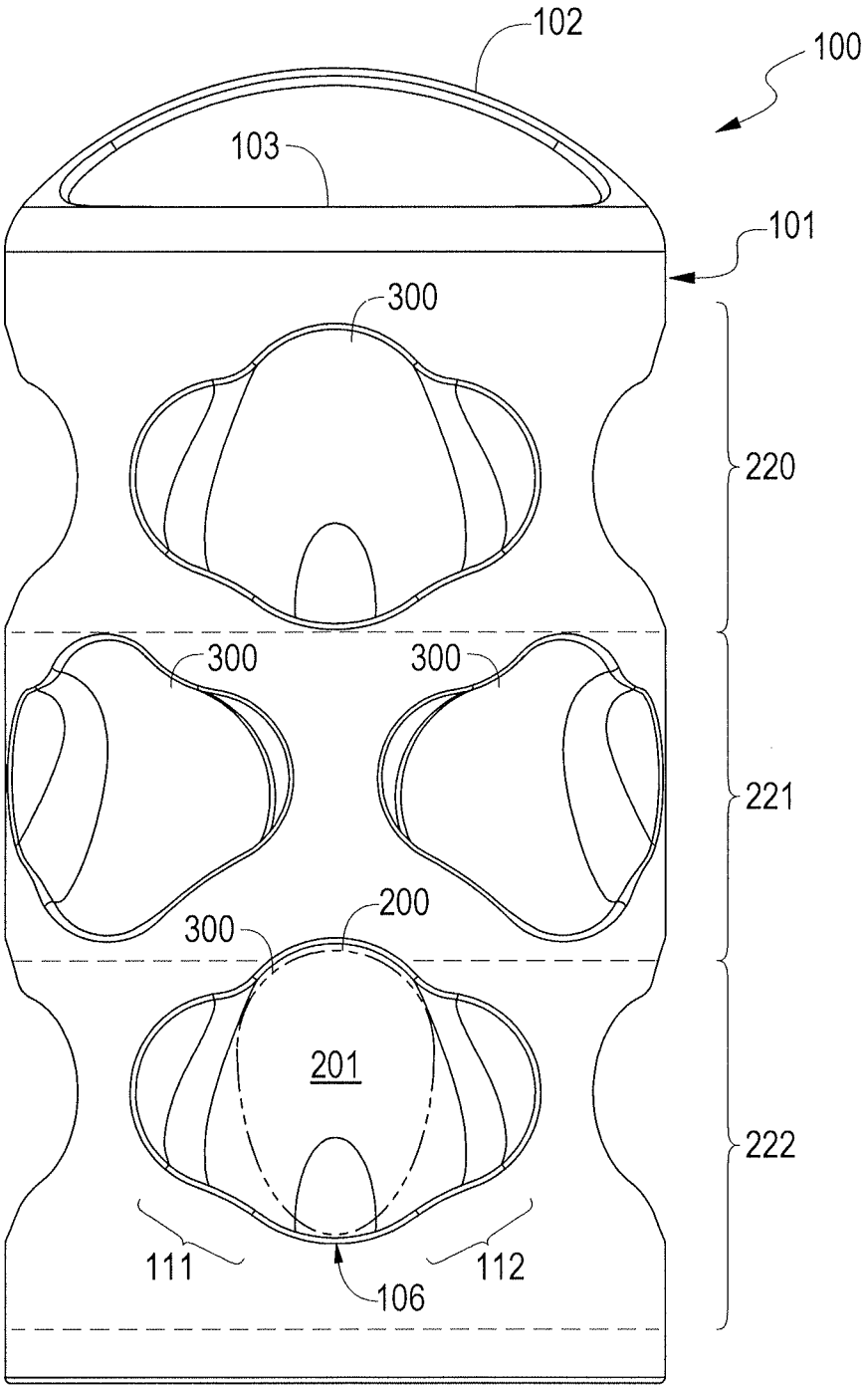
FIG. 2 is a side view of the egg carrier depicted in FIG. 1.

In another embodiment, each opening 106 comprises a top arched edge 108 that mirrors a bottom arched edge 107. Each opening 106 further comprises an arched side edge 109. The arched side edge 109 exhibits a slope that is greater than a slope of the top arched edge 108 and the bottom arched edge 107. Thus, the arched side edge 109 creates a portion 111 of the opening 106 that extends beyond a surface of the egg received in the opening 106, which is shown in FIG. 2. Likewise, each opening 106 also comprises an arched side edge 110 mirroring the arched side edge 109. The arched side edge 110 exhibits a slope that is greater than the slope of the top arched edge 108 and the bottom arched edge 107. Thus, the arched side edge 110 creations a portion 112 of the opening 106 that extends beyond the surface of the egg received in the opening 106. The spatial portions 111 and 112 of the opening 106 create space for reception of a user's fingers when the egg is being inserted within the opening 106.

Notably, the top and bottom arched edges 108 and 107, respectively, each have a radius of curvature that is larger than the radius of curvature of the arched side edges 109 and 110. Thus, the top and bottom arched edges 108 and 107 have a curvature with a smaller slope than the slope of the curvature of the arched side edges 109 and 110.

The cylindrical housing 101 further comprises an arched handle 102. In one embodiment, the arched handle 102 is formed from an extension of the top edge 103. In this regard, the handle 102 is integral with and is an extension of the top edge 103. In another embodiment, the handle 102 may be a separately formed member that is coupled to the top edge 103 via fasteners (not shown).

FIG. 2 is a side view of the egg carrier 100. The side view of FIG. 2 depicts an egg 200 inserted within one of the openings 106. Note the opening portions 111 and 112 that provide space beyond a surface 201 of the egg for receiving a user's fingers when inserting the egg 200 into the opening 106.

Further, FIG. 2 depicts the arched handle 102. In the embodiment depicted, the handle 102 and the edge 103 are integral. In this regard, the edge 103 is contiguous with the handle 102. In another embodiment, the handle 102 is a separate member that is coupled to the egg carrier 100 via fasteners (not shown).

Additionally, there are layers of receptacles 300 disposed within the egg carrier 100. In the embodiment depicted, the egg carrier 100 comprises a top layer 220 of receptacles 300, a middle layer 221 of receptacles 300, and a lower layer 222 of receptacles 300.

In the embodiment depicted, the top layer 220 of the receptacles 300 are aligned such that there are four (4) openings 106 in the top layer 220. Note that while four openings 106 are shown in the top layer 220, more or fewer receptacles may form the top layer 220 in other embodiments.

Further, the middle layer 221 of the receptacles 300 are aligned such that there are four openings 106 in the middle layer 221. Note that while four openings 106 are shown in the middle layer 221, more or fewer receptacles may form the middle layer 221 in other embodiments.

Further, the bottom layer 222 of the receptacles 300 are aligned such that there are four openings 106 in the bottom layer 222. Note that while four openings 106 are shown in the bottom layer 222, more or fewer receptacles may form the bottom layer 222 in other embodiments.

Accordingly, the embodiment of the egg carrier 100 depicted in FIG. 2 comprises twelve (12) openings 106 and twelve (12) corresponding receptacles 300. Thus, the egg carrier 100 may house at most twelve (12) eggs 200 while in use. Note that while the egg carrier 100 depicted in FIG. 2 may house twelve (12) eggs 200, in other embodiments, the egg carrier 100 may comprise additional or fewer openings 106 and corresponding receptacles 300 in other embodiments. Therefore, an egg carrier 100 in accordance with an embodiment of the present disclosure may house fewer or more eggs 200 in other embodiments.

Figure 3:
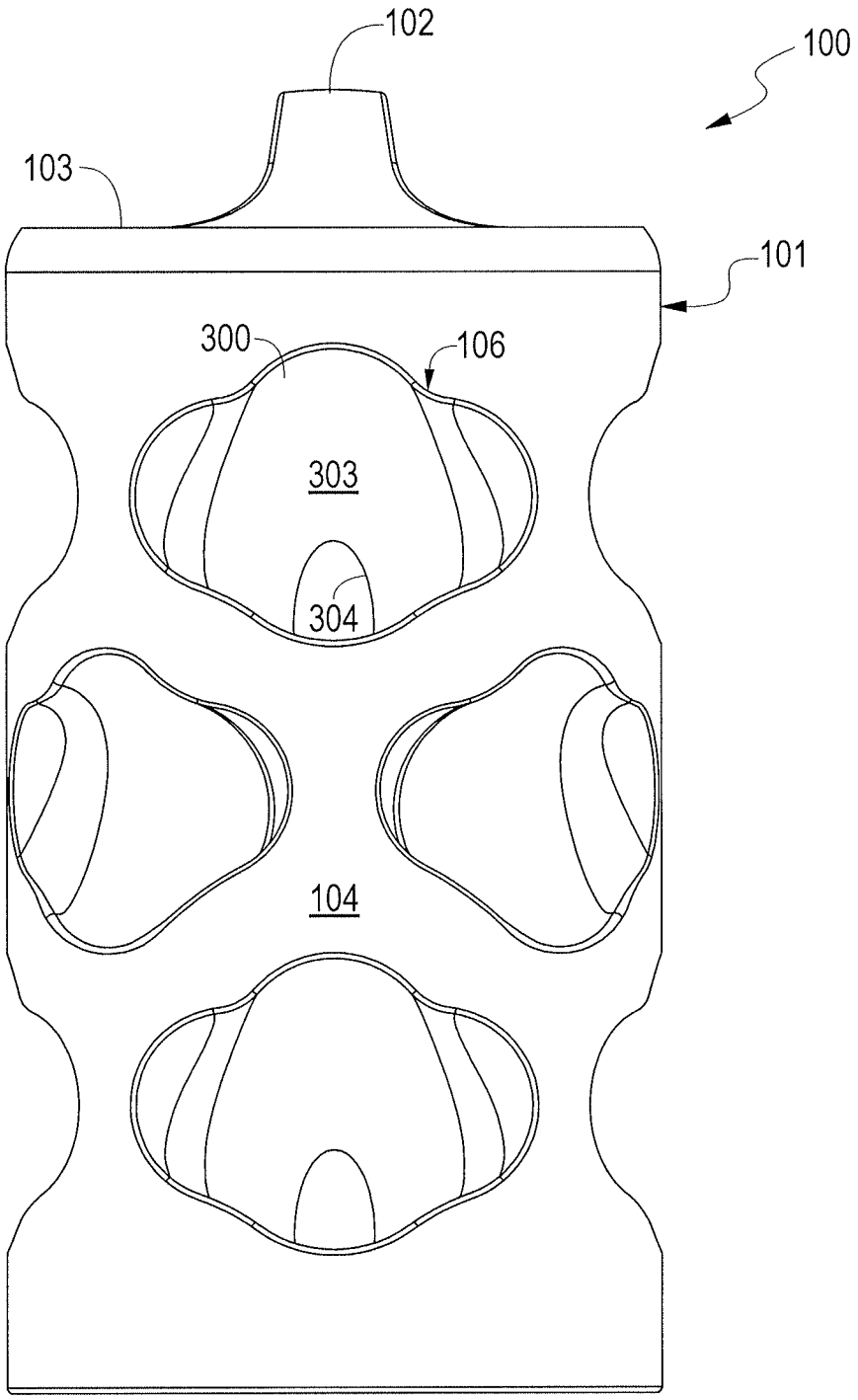
FIG. 3 is another side view of the egg carrier depicted in FIG. 1.

FIG. 3 is another side view of the egg carrier 100. FIG. 3 shows the handle 102 contiguous with the edge 103. Further, disposed in the lateral curved surface 104 is the plurality of openings 106.

Within each opening 106 is an oval-shaped receptacle 300 that forms a cavity that is substantially oval-shaped for retaining the received egg 200 (FIG. 2), the cavity is shown and further described with reference to FIG. 6. Each receptacle 300 comprises a tapered wall 303 that extends from the opening 106 to an opening 304 formed in the receptacle 300. The opening 304 in the receptacle 300 is adapted and arranged for eliminating moisture or debris from the egg 200 (FIG. 2) when the egg 200 is inserted within the receptacle 300. As will be described further with reference to FIGS. 4, 5, and 6, traversing the cylindrical housing 101 lengthwise is a cavity through which moisture and debris can escape the cylindrical housing 101, which is shown with reference to FIG. 6.

Figure 4:
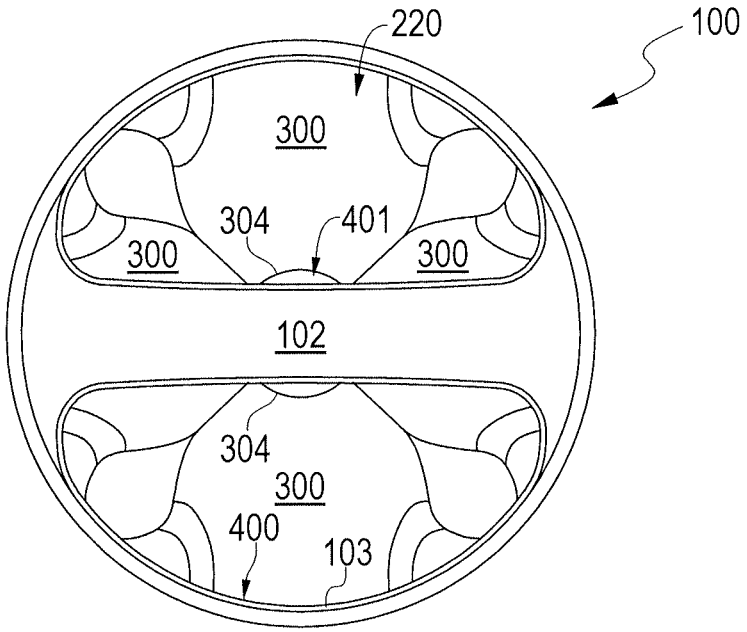
FIG. 4 is a top view of the egg carrier depicted in FIG. 1.

FIG. 4 is a top view of the egg carrier 100. FIG. 3 depicts the handle 102 contiguous with the top edge 103 of the cylindrical housing 101. Further, the top view of the egg carrier 100 shows that the edge 103 forms an opening 400 in the top of the egg carrier 100.

In one embodiment, four of the plurality of receptacles 300 show through the opening 400 in the top of the egg carrier 100. Further, the opening 400 shows the openings 304 of the receptacles 300. Note that the two receptacles 300 shown are disposed on the same plane and each receptacle 300 mirrors an opposing receptacle 300. The openings 304 are formed in the receptacles 300 such that each opens to a cavity 401 that is formed lengthwise of the egg carrier 100. This is shown further with reference to FIG. 6.

As noted, four (4) receptacles 300 form the top layer 220 of the receptacles 300. In this regard, the receptacles 300 are aligned and disposed radially to form the top layer 220. Note that the middle layer 221 is substantially similar having four (4) receptacles 300; however, the receptacles 300 of the middle layer 221 are not aligned with the receptacles 300 of the top layer 220. Instead, they are offset from the receptacles 300 of the top layer 220 so as to maximize space within the egg carrier 100.

Figure 5:
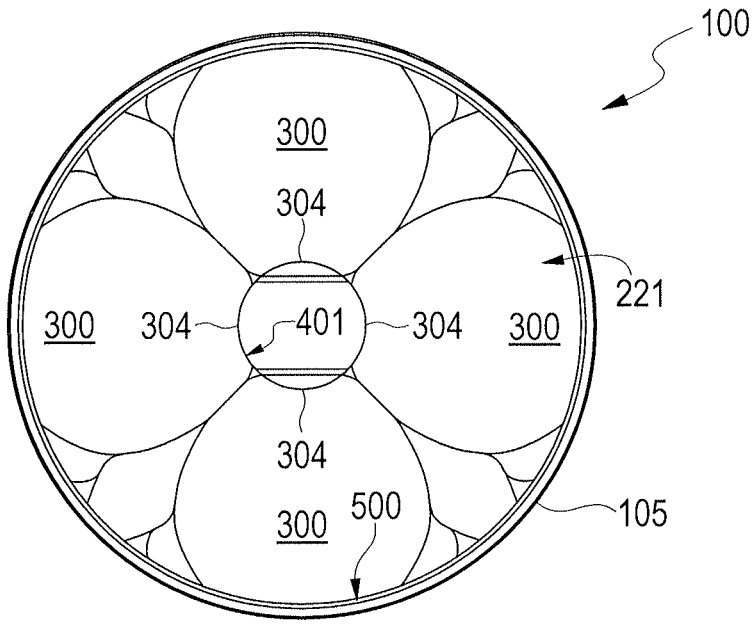
FIG. 5 is a bottom view of the egg carrier depicted in FIG. 1.

FIG. 5 depicts a bottom view of the egg carrier 100. The egg carrier 100 comprises the bottom edge 105 that forms an opening 500 in the bottom of the egg carrier 100.

In one embodiment, four of the receptacles 300 are shown through the opening 500 in the top of the egg carrier 101. Further, the opening 500 shows the openings 304 of the receptacles 300. Note that the two receptacles 300 shown are disposed on the same plane and each receptacle 300 mirrors an opposing receptacle 300. The openings 304 are formed in the receptacles 300 such that each opens to the cavity 401 that is formed lengthwise of the egg carrier 100. This is shown further with reference to FIG. 6.

As noted, four (4) receptacles 300 form the bottom layer 222 of the receptacles 300. In this regard, the receptacles 300 are vertically aligned and disposed radially to form the top layer 220. Note that the middle layer 221 is substantially similar having four (4) receptacles 300; however, the receptacles 300 of the middle layer 221 are not aligned with the receptacles 300 of the bottom layer 222. Instead, the receptacles 300 are offset from the receptacles 300 of the middle layer 221 and aligned with the receptacles 300 of the top layer 220 so as to maximize space within the egg carrier 100.

Figure 6:
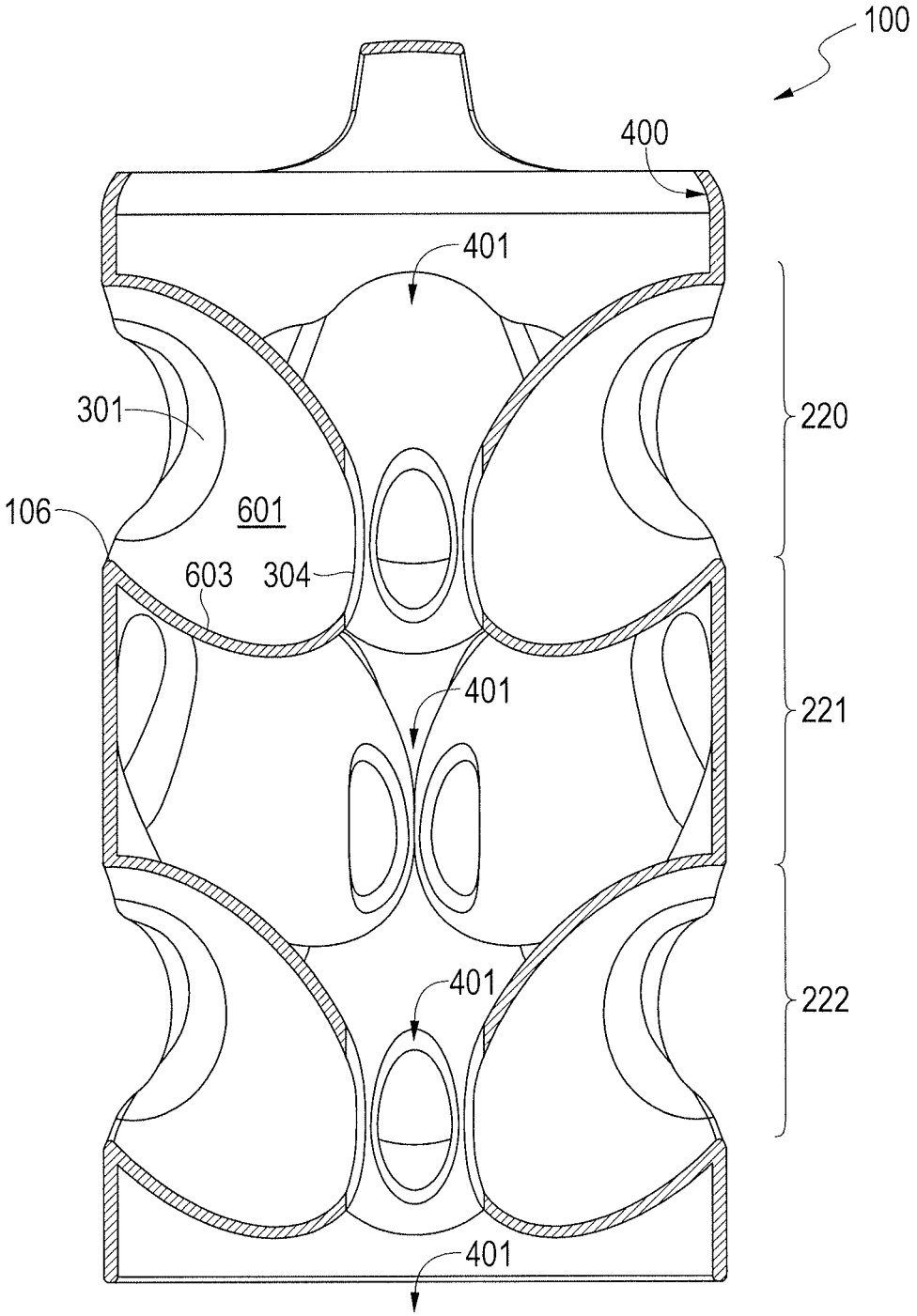
FIG. 6 is a cross sectional view of the egg carrier depicted in FIG. 1.

FIG. 6 depicts a cross-sectional view of the egg carrier 100. Notably, each receptacle 300 comprises a tapered wall 301 that forms a cavity 601. Each cavity 601 is oval-shaped for receiving the egg 200 (FIG. 2).

Each cavity 601 slopes downward from the opening 106. Such downward slope of the cavities 601 is in a direction away from the top of the egg carrier 100. Thus, because the eggs 200 are inserted into the cavities 601 having a downward slope at an angle, the downward slope ensures that when the egg carrier 100 is being carried, the eggs 200 inserted in the cavities 601 are retained in the egg carrier 100.

Further, a cavity 401 is formed in the egg carrier 100 by the receptacles 300, the opening 400 in the top of the egg carrier 100, and the opening 500 in the bottom of the egg carrier 100. At least a portion of the cavity 401 runs lengthwise of the lateral curved surface 104.

Note that FIG. 6 depicts the receptacle layers 220, 221, and 222. The receptacles 300 in the top layer 220 are vertically aligned and disposed radially in the egg carrier 100. The receptacles 300 in the middle layer 221 are offset from the receptacles 300 in the top layer 220 and vertically aligned and disposed radially in the egg carrier 100. Further, the receptacles 300 in the bottom layer 222 are aligned with the receptacles 300 in the top layer 220, offset from the receptacles 300 in the middle layer 221, and the receptacles 300 in the bottom layer 222 are aligned and disposed radially in the egg carrier 100.

What is claimed is:

1. An egg carrier, comprising:

a housing having an external surface;

a plurality of openings disposed in the external surface of the housing;

a plurality of receptacles arranged in layers around the external surface such that a middle layer is atop a bottom layer and a top layer is atop the middle layer, each receptacle accessible by one of the plurality of openings and having an oval-shaped internal wall forming an oval-shaped cavity for receiving an egg, wherein the housing is cylindrical-shaped, the cylindrical-shaped housing has a lateral curved surface, and the plurality of openings are disposed in the lateral curved surface and the lateral curved surface terminates at a top edge of the housing and at a bottom edge of the housing, and wherein the top edge forms a first opening in a top of the housing, and the bottom edge forms a second opening in a bottom of the housing.

2. The egg carrier of claim 1, wherein a handle is unitary with and is an extension of the top edge of the housing.

3. The egg carrier of claim 1, wherein the handle is coupled to the top edge via one or more fasteners.

4. The egg carrier of claim 1, wherein the plurality of receptacles, the first opening, and the second opening form a cavity within the housing.

5. The egg carrier of claim 4, wherein a portion of the cavity runs lengthwise and parallel to the lateral curved surface.

6. The egg carrier of claim 5, wherein each of the plurality of receptacles comprises an opening adapted within the oval-shaped external wall that through which is the portion of the cavity that runs lengthwise and parallel to the lateral curved surface such that debris or moisture from the egg inserted in the cavity escapes the housing through the portion of the cavity.

7. The egg carrier of claim 1, wherein each opening is substantially circular.

8. The egg carrier of claim 7, wherein each opening has a first extended portion and a second extended portion for reception of a user's fingers when the egg is being inserted into the cavity.

9. An egg carrier, comprising:

a housing having an external surface;

a plurality of openings disposed in the external surface of the housing;

a plurality of receptacles arranged in layers around the external surface such that a middle layer is atop a bottom layer and a top layer is atop the middle layer, each receptacle accessible by one of the plurality of openings and having an oval-shaped internal wall forming an oval-shaped cavity for receiving an egg, wherein each opening comprises a top arched edge that mirrors a bottom arched edge, wherein each opening further comprises a first arched side edge, wherein the arched side edge has a slope that is greater than a slope of the top arched edge and the bottom arched edge, and wherein the arched side edge forms a portion of the opening that extends beyond a surface of the egg creating a space for reception of a user's fingers when the egg is being inserted within the opening.

10. The egg carrier of claim 9, wherein each opening further comprises a second arched side edge that opposes and mirrors the first side edge, wherein the second arched side edge has a slope that is greater than a slope of the top arched edge and the bottom arched edge.

11. An egg carrier, comprising:

a housing having an external surface;

a plurality of openings disposed in the external surface of the housing;

a plurality of receptacles arranged in layers around the external surface such that a middle layer is atop a bottom layer and a top layer is atop the middle layer, each receptacle accessible by one of the plurality of openings and having an oval-shaped internal wall forming an oval-shaped cavity for receiving an egg, wherein each opening comprises a top arched edge that mirrors a bottom arched edge and each opening further comprises a first arched side edge that has a slope that is greater than a slope of the top arched edge, wherein each opening further comprises a second arched side edge that opposes and mirrors the first side edge, wherein the second arched side edge has a slope that is greater than a slope of the top arched edge and the bottom arched edge, and wherein the first arched side edge forms a first portion of the opening that extends beyond a surface of the egg and the second edge forms a second portion of the opening that extends beyond the surface of the egg creating a space on both sides of the egg for reception of a user's fingers when the egg is being inserted within the opening.

12. An egg carrier, comprising:

a housing having an external surface;

a plurality of openings disposed in the external surface of the housing;

a plurality of receptacles arranged in layers around the external surface such that a middle layer is atop a bottom layer and a top layer is atop the middle layer, each receptacle accessible by one of the plurality of openings and having an oval-shaped internal wall forming an oval-shaped cavity for receiving an egg, wherein each layer comprises the same number of receptacles and each receptacle in each layer is offset from receptacles in an adjacent layer thereby maximizing space for carrying eggs.

* * * * *